US006490820B1

(12) United States Patent
Weakley

(10) Patent No.: US 6,490,820 B1
(45) Date of Patent: Dec. 10, 2002

(54) DISPLAY SYSTEM

(75) Inventor: Scott Weakley, Mississauga (CA)

(73) Assignee: J&J Display Sales, Mississauga (CA)

( * ) Notice: Subject to any disclaimer, the term of this patent is extended or adjusted under 35 U.S.C. 154(b) by 0 days.

(21) Appl. No.: 09/215,324

(22) Filed: Dec. 18, 1998

(51) Int. Cl.[7] ..... G09F 3/18
(52) U.S. Cl. ..... 40/651; 40/661
(58) Field of Search ..... 40/651, 653, 654.01, 40/661.08, 661

(56) References Cited

U.S. PATENT DOCUMENTS

| | | | | | |
|---|---|---|---|---|---|
| 2,053,746 | A | * | 9/1936 | Sheldon | 40/658 |
| 2,592,386 | A | * | 4/1952 | Breakey | 40/658 |
| 2,679,846 | A | * | 6/1954 | Addison | 40/661.03 |
| 4,208,818 | A | | 6/1980 | Butcher | |
| 4,338,739 | A | | 7/1982 | Greenberger | |
| 4,384,418 | A | | 5/1983 | Alley | |
| 4,557,064 | A | | 12/1985 | Thompson | |
| 4,704,813 | A | | 11/1987 | Fast | |
| 4,995,182 | A | | 2/1991 | Fast | |
| 5,375,803 | A | | 12/1994 | Kump | |
| 5,419,066 | A | | 5/1995 | Harnois et al. | |
| 5,458,307 | A | | 10/1995 | Gebka | |
| 5,473,833 | A | | 12/1995 | Ostrovsky | |
| 5,488,793 | A | | 2/1996 | Gebka et al. | |
| 5,682,698 | A | | 11/1997 | Bevins | |
| 5,967,343 | A | * | 10/1999 | Dufresne | 40/661.03 |
| 6,026,603 | A | * | 2/2000 | Kump et al. | 40/661.03 |

FOREIGN PATENT DOCUMENTS

| | | | | |
|---|---|---|---|---|
| DE | 2529546 | * | 1/1977 | 40/661 |

* cited by examiner

*Primary Examiner*—Cassandra H. Davis
(74) *Attorney, Agent, or Firm*—Synnestvedt & Lechner LLP

(57) ABSTRACT

A display system having a holding member which includes a stopping member and a retaining groove. The display system further comprises a display panel having a lip that may securely attach the display panel to the holding member.

16 Claims, 7 Drawing Sheets

88
10
38
40
12
16
92
94
102
14
14
14
104
84
18
22
86
90
24
20
82
102
98

68
66
64
62
58
56
60
72
70

DISPLAY SYSTEM

FIELD OF INVENTION

This invention relates generally to a display device and more specifically to a display system having a display panel that can securely engage a display shelf.

BACKGROUND OF INVENTION

Display systems have been developed in the past to exhibit a wide variety of advertising in merchandise outlets such as supermarkets and the like. In-store merchandising systems have often included C-channels on steel merchandise shelves that accommodate either labels or sign holders. The varying sizes of the C-channels result in the labels and sign holders becoming displaced or not fitting properly. To overcome this problem and effectively secure the labels or sign holders, it is often necessary to force the label into the C-channel or glue the label to the channel. This results in problems when the labels have to be removed from the channel once labels are no longer required.

Prior art display systems have been devised to address the aforenoted problems. For example, U.S. Pat. No. 5,473,833 issued on Dec. 12, 1995 to Ostrovsky, relates to a clip-on label holder and cover. The clip-on label holder may be inserted into a price ticket channel member of a shelf. The cover comprises an elongate clear plastic strip, having a clear plastic display panel and an integral clip.

Harnois et al. is the owner of U.S. Pat. No. 5,419,066 which issued on May 30, 1995. This patent relates to a card holder extrusion mounted on a conventional card holder located in front of a shelf.

U.S. Pat. No. 5,488,793 issued to Gebka et al. on Feb. 6, 1996. This patent relates to an extruded plastic price channel which can be fitted into a C-channel at the front of a merchandise shelf to provide a mounting for merchandise labelling.

U.S. Pat. No. 5,458,307 was issued on Oct. 17, 1995 to Gebka. This patent relates to a ribbed plastic price channel for use on a product display shelf to receive product labels. The ribbed plastic price channel has a high friction coating on the ribs to reduce the tendency for an inserted label to slide along the channel and out a position.

U.S. Pat. No. 4,995,182 was issued on Feb. 26, 1991 to Fast. A sign holder is disclosed for use in attaching label cards or other signs in prominent positions. The sign holder may project from a front edge of supermarket and like product display shelves.

U.S. Pat. No. 4,557,064 was issued on Dec. 10, 1985 to Thompson. This patent relates to a plastic display card holder for receiving and gripping a card for display purposes and comprises of interconnected spaced-apart parallel wall portions.

U.S. Pat. No. 4,384,418 was issued on May 24, 1983 to Alley. This patent relates to a shelf display and is constructed for vertical elastic mounting of a product information member between upper and lower shelves.

U.S. Pat. No. 4,208,818 was issued on Jun. 24, 1980 to Butcher. This patent relates to a display device for displaying two similar articles on a store shelf. The display device has a base portion which includes a flat sheet adapted to overlie a shelf which is generally horizontal. A flexible sign holder is connected to the front of the flat sheet and extends forwardly and downwardly therefrom for containing pricing information.

U.S. Pat. No. 5,682,698 was issued on Nov. 4, 1997 to Bevins. This patent relates to a plastic sign holder and is designed to fit into C-channels of different heights along front edges of respective merchandise display shelves. The holder is a plastic sheet with downwardly folded flaps of different heights at the top and bottom edges. The flaps are adapted to the heights of the respective channels so that the holder can be reversed for selective use in either channel.

U.S. Pat. No. 4,338,739 was issued on Jul. 13, 1982 to Greenberger. This patent relates to a display device which is adapted for use in conjunction with conventional shelf moldings. The sign includes a first portion which snaps within the molding and a second portion which extends therefrom.

U.S. Pat. No. 5,375,803 was issued on Dec. 27, 1994 to Kump. This patent relates to a holder for planar or sheet material includes a first panel, a second panel and a hinge along which an edge of the first panel is secured to an edge of the second panel.

U.S. Pat. No. 4,704,813 was issued on Nov. 10, 1987 to Fast. This patent relates to a multipurpose display card holder that is formed from a rectangular blank of plastic sheet. The blank is divided by three transverse crease lines into four contiguous panels namely a base forming panel at one end of the blank, a first card holder panel adjacent the base forming panel, a bridging panel adjacent the first card holder panel and a second card holder panel adjacent the bridging panel at the other end of the blank.

Thus a display system which provides an easy and secure way of attaching and detaching a display panel to a merchandise display shelf without the need for a C-channel or fasteners is desirable.

SUMMARY OF THE INVENTION

An object of one aspect of the present invention is to provide an improved display system.

In accordance with one aspect of the present invention, there is provided a display system comprising of a holding means having at least two panels, a stopping member and a retaining grove. The display system may further comprise of a display means having a locking member wherein the locking member fits securely into the retaining groove, and the stopping member prevents the display means from being dislodged.

Preferably, the holding means may be further defined by three panels, wherein the three panels are oriented into a Z-shape. The holding means may also be defined with two panels, a front panel and a back panel that are associated with one another so that the display means may fit securely between the two panels.

Conveniently, the stopping member may be further defined as an angled rib and the display means may be defined as a folded display panel having a front edge and a back edge. Preferably the locking member may be a lip located on the back edge of the folded display panel.

In accordance with still another aspect of the invention, there is provided a method for removably mounting a display system having a Z-shaped holding means which may have a stopping member and retaining groove and a display means which may have a locking member. The method requires attaching the Z-shaped holding means to a display shelf, and then attaching the display means to the Z-shaped member wherein the locking member snaps into the retaining groove and the stopping member holds the display means in an attached position.

BRIEF DESCRIPTION OF DRAWINGS

A detailed description of the preferred embodiments are provided herein below by way of example only with reference to the following drawings, in which.

Figure 1:
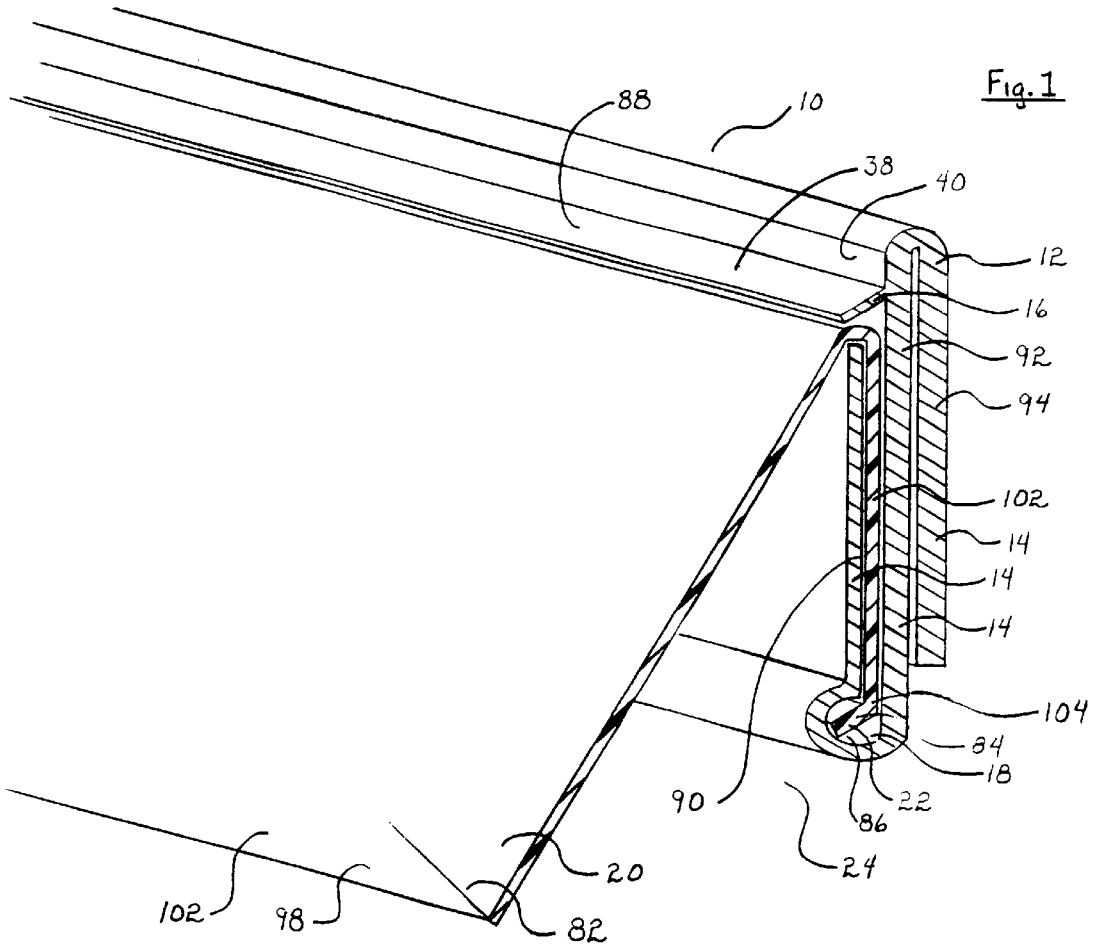
FIG. 1, in a perspective view, illustrates a display system in accordance with a preferred embodiment of the present invention.

In the drawings, preferred embodiments of the invention are illustrated by way of example. It is to be expressly understood that the description and the drawings are only for the purpose of illustration and as an aid to understanding, and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Figure 6:
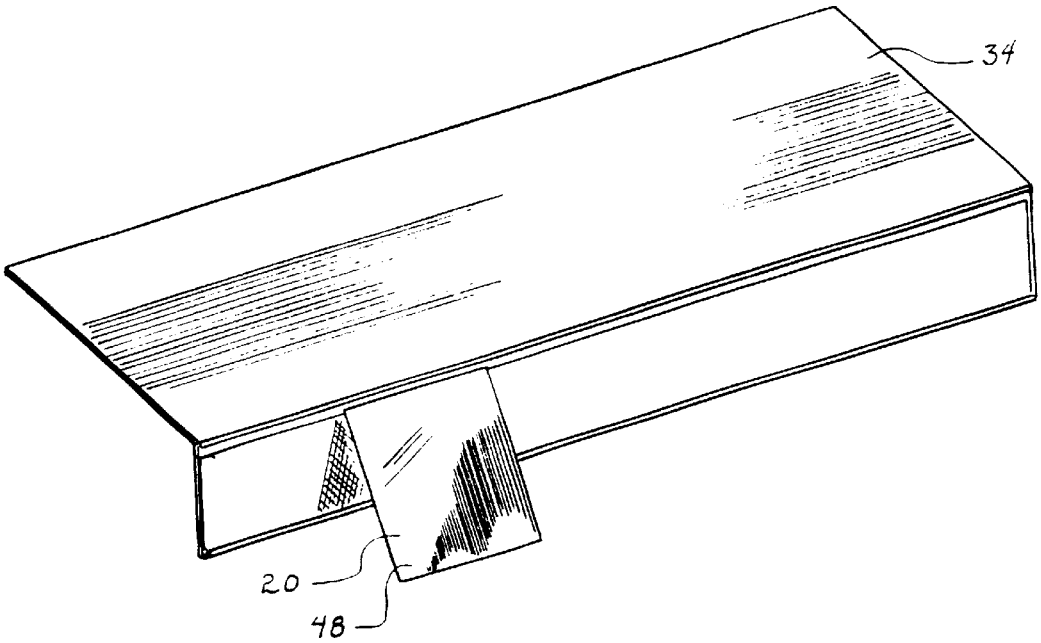
FIG. 6, in a perspective view, illustrates the display system in operation.
Figure 7:
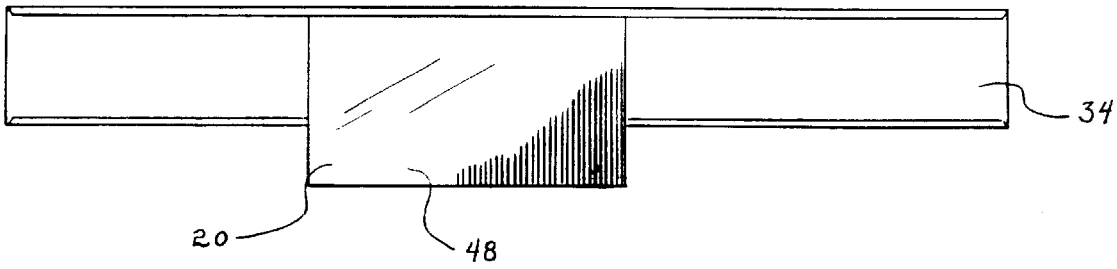
FIG. 7, in a front view, illustrates the display system in operation.

Referring to FIGS. 1, 6 and 7 there is illustrated in a perspective view, a display system 10 in accordance with a preferred embodiment of the present invention. The display system 10 includes a holding means 12 comprising of at least two panels 14, a stopping member 16 and a retaining groove 18.

The display system 10 also includes a display means 20 having a locking member 22. The locking member 22 of the display means 20 may associate with the retaining groove 18 of the holding means 12 and the stopping member 16 may associate with the display means 20 so that the display means 20 is secure in an attached position 24.

Figure 3:
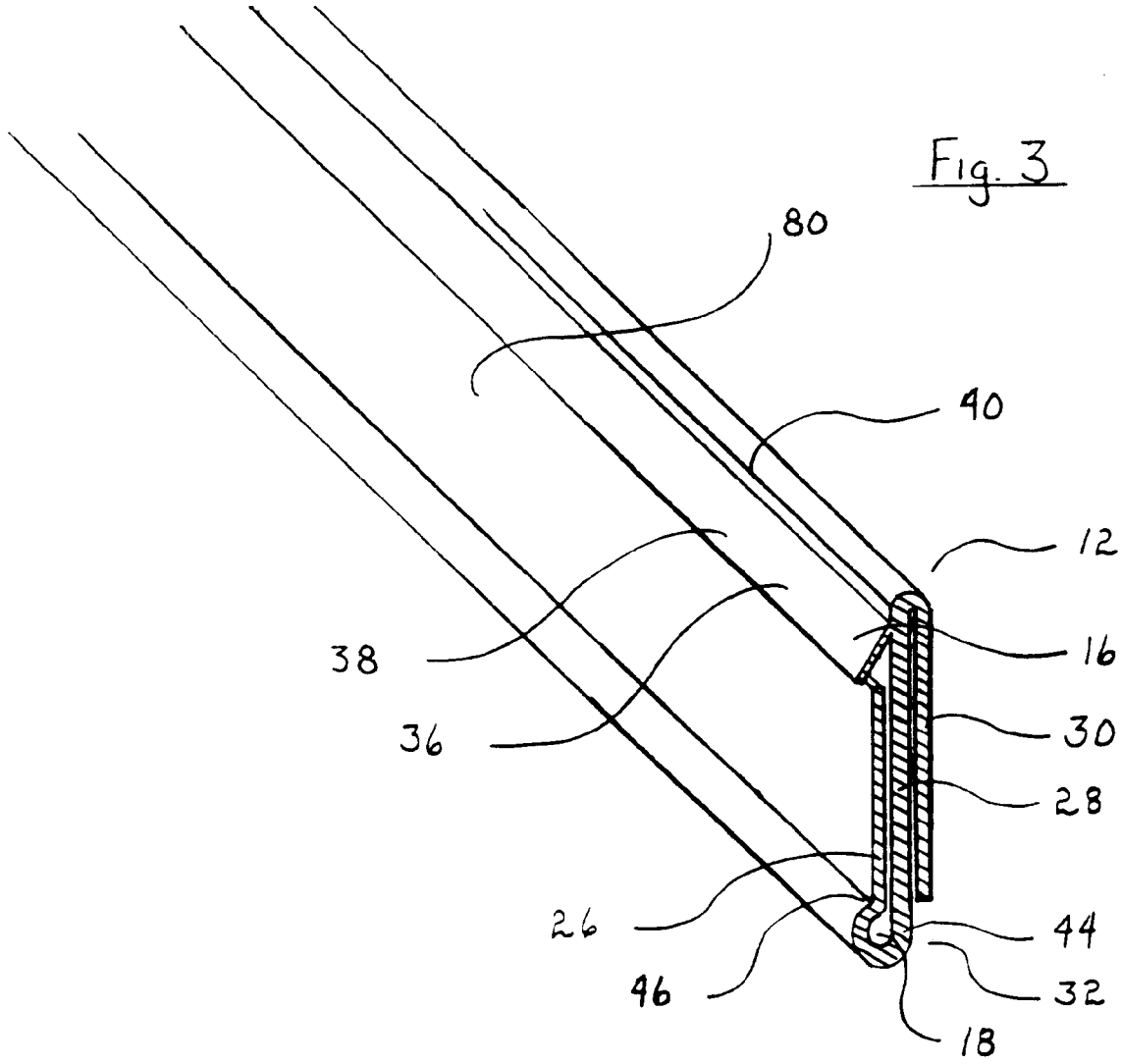
FIG. 3, in a perspective view, illustrates the holding means in accordance with the preferred embodiment described in FIG. 1.

Referring to FIG. 3, the holding means 10 may be further defined as having three panels, a front panel 26, an internal panel 28, and a back panel 30. The three panels may associated with one another in a Z-shape 32. In the Z-shape 32 orientation, the back panel 30 may engage a conventional display shelf 34, as seen in retail stores.

The stopping member 16 may be further defined as a rib 36 that can associate with the internal panel 28 of the Z-shape 32 holding means 12. More specifically, the rib 36 may be angled in a downward direction 38 at the top edge 40 of the internal panel 28. The downward direction 40 of the angled rib 36 allows the display means 20 to be securely held in the Z-shaped 32 holding means 12 in the attached position 24. This is accomplished as the angled rib 36 prevents the display means 20 from moving in an upward direction if the display means 20 is moved or knocked by a passer-by.

Figure 5:
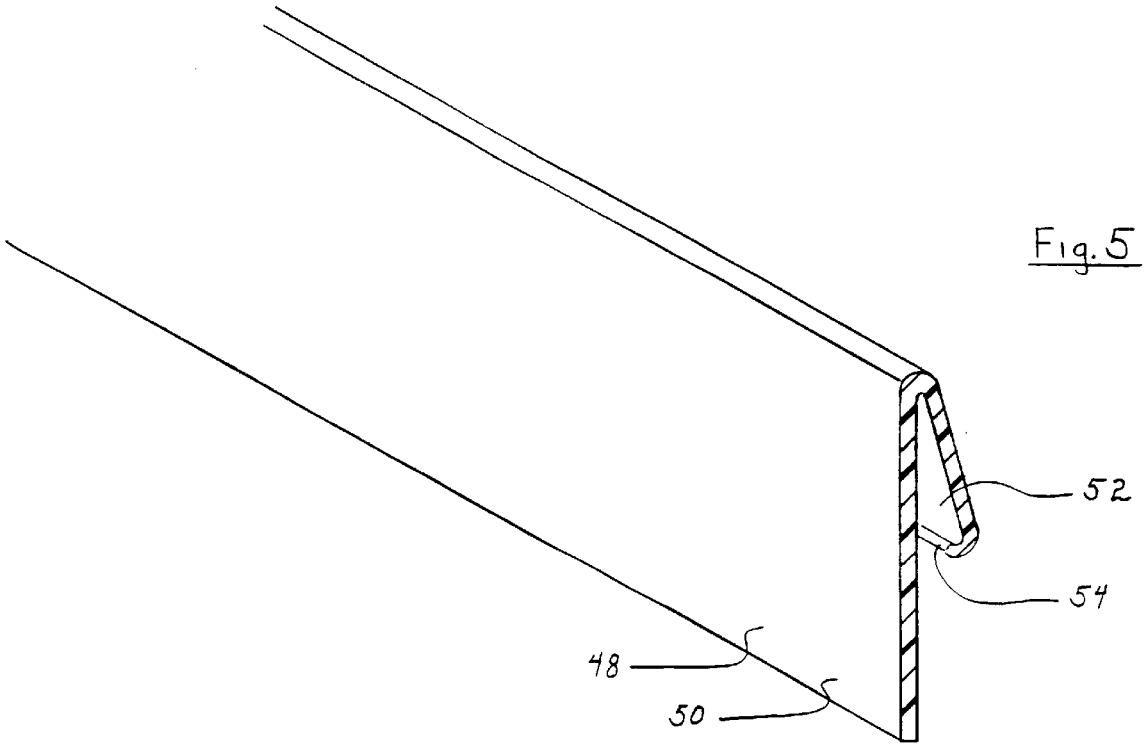
FIG. 5, in a perspective view, illustrates the display panel in accordance with the preferred embodiments described in FIG. 1 and 2.

Referring to FIG. 5, the display means 20 may be further defined as comprising a folded display panel 48. Folded display panel 48 may have a front edge 50 and a back edge 52. The locking member 22 may associate on the back edge 52 of the folded display panel 48. The locking member 22 may be further defined as a lip 54.

Referring to FIG. 3, retaining groove 18 is formed by the association of the bottom edge 44 of internal panel 28 and the bottom edge 46 of front panel 26. Specifically, the lip 54 of the folded display panel 48 may fit into the retaining groove 18 so as to securely attach the folded display panel 48 to the Z-shaped 32 holding means 12. The display system 10 may be made from rigid plastic so as to give strength and structure to the display means 20 and the locking member 22. This additional rigidity also allows for the locking member 22 or lip 54 to "snap" into the retaining groove 18 thereby helping to secure the display means 20 to the Z-shaped holding means 12.

The rigidity of the plastic also enables the angled rib 36 to act as an effective stopping member 16, and the back panel 28 to attach to the display shelf 34 and support the weight of the display system 10. The display system 10 may also be made from a transparent material to allow for a "see-through" effect. The display means 20 may have various advertising or promotional material or the like on its surface to alert the consumer.

Figure 2:
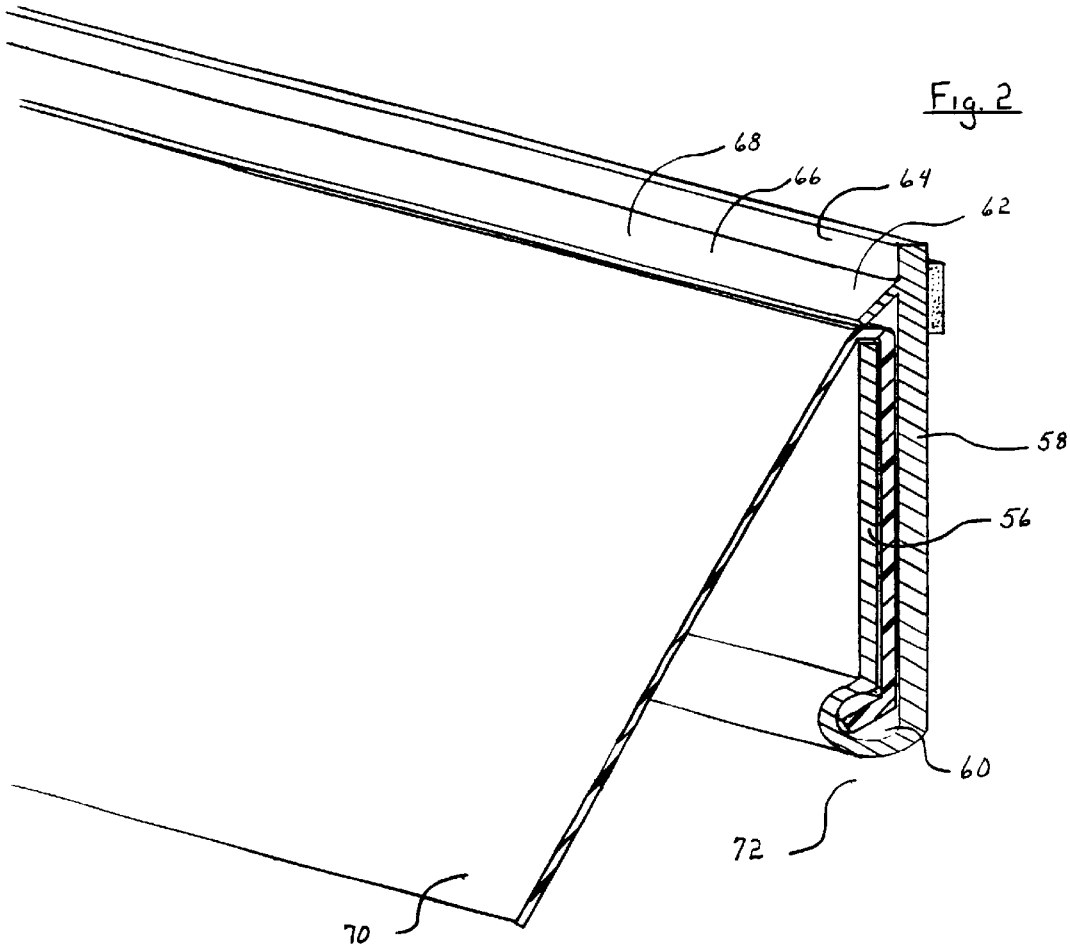
FIG. 2, in a perspective view, illustrates a display system in accordance with a second preferred embodiment of the present invention.
Figure 4:
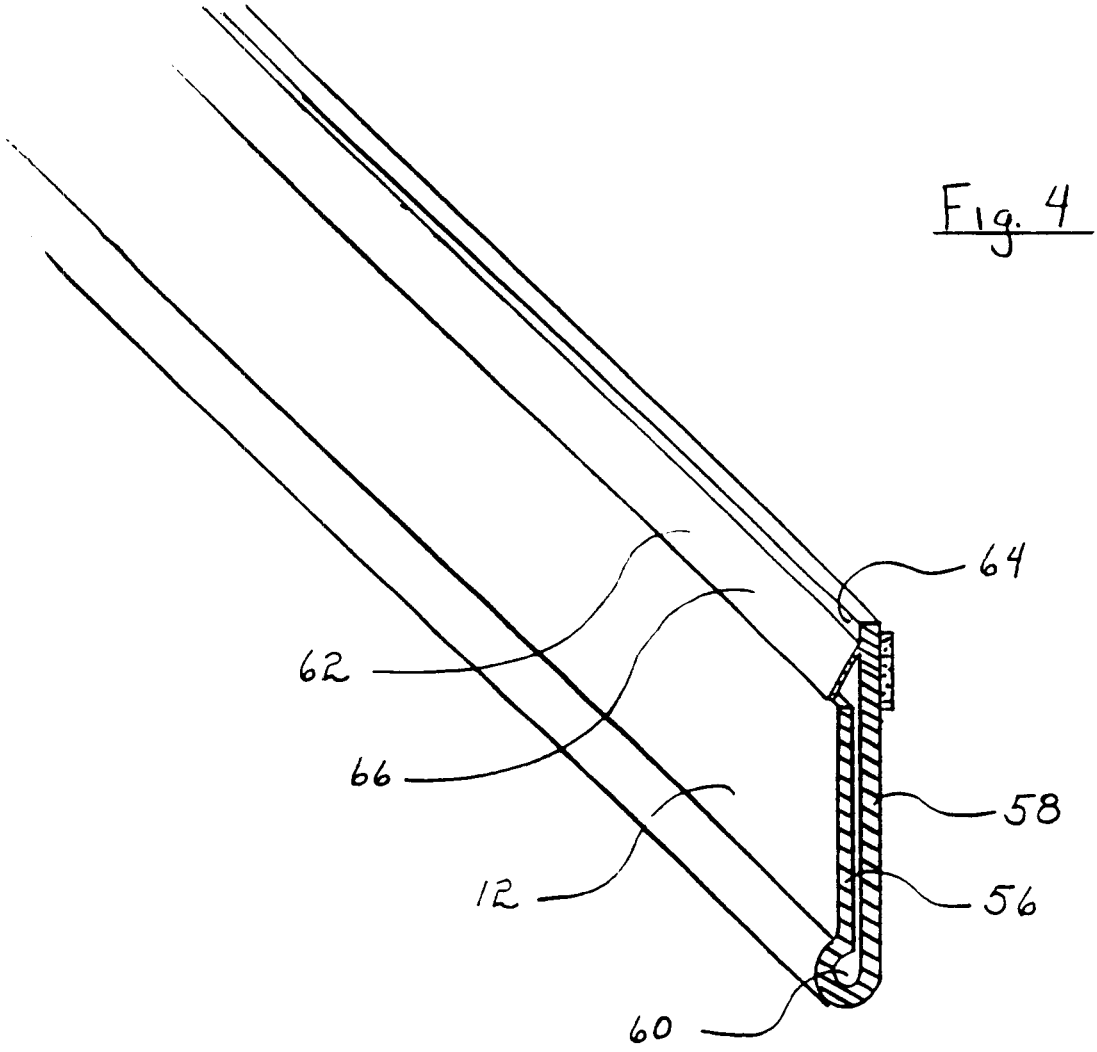
FIG. 4, in a perspective view, illustrates the holding means in accordance with the preferred embodiment described in FIG. 2.

Referring to FIGS. 2 and 4, holding means 12 of the display system 10 may also be comprised of only a front panel 56 and a back panel 58. The front panel 56 and the back panel 58 may be oriented juxtaposed to one another and connected to form a retaining groove 60. A stopping member 62 may be located at the top edge 64 of the back panel 58. As described for the embodiment shown in FIG. 1 and 3, the stopping member 62 may be further defined as a rib 66.

More specifically, the rib 66 may be angled in a downward direction 68 at the top edge 64 of the back panel 58. The downward direction 68 of the angled rib 66 allows the display means 70 to be securely held between the back panel 58 and the front panel 56 in the attached position 72. This is accomplished as the angled rib 66 prevents the display means 70 from moving in an upward direction if the display means 70 is moved or knocked by a passer-by. The back panel 58 may be attached to a display shelf 34 by means of a fastener, such as adhesive tape and the like.

Referring to FIGS. 1 and 3, in operation, the display system 10 having a Z-shaped holding means 80 may be removably mounted to a display shelf 34 using the following method: attaching the Z-shaped holding means 80 to a display shelf 34; attaching the display means 82 to the Z-shaped holding means 80 by snapping the locking member 84 of the display means 82 into the retaining groove 86; positioning the display means 82 securely to the Z-shaped holding means 80 with the aid of the stopping member 88.

As described above, the Z-shaped holding means 80 may be further defined as a front panel 90, an internal panel 92 and a back panel 94, wherein the back panel 94 attaches the display system 10 to the display shelf 34, and the internal panel 92 and the back panel 94 hold the display means 82 in an attached position 24. The display means 82 may be further defined as a folded display panel 98 having a back edge 100 and a front edge 102. The locking member 84 may be further defined as a rigid lip 104 located on the back edge 100 of the folded display panel 98. The rigid lip 104 may snap into the retaining groove 86 to secure the folded display panel 98 to the Z-shaped holding means 80. The display system 10 may be made from resilient plastic or the like, and may be transparent.

Various embodiments of the invention have now been described in detail. Since changes in and/or additions to the above-described best mode may be made without departing from the nature, spirit or scope of the invention, the invention is not to be limited to said details.

I claim:

1. A display member to engage with a holding member having two panels and retaining means located between the two panels, the display member comprising:

a display panel; and a second panel receivable between the two panels of the holding member, the second panel being connected to the display panel, the second panel having a locking member that is capable of securing the display member to the retaining means of the holding member, the locking member being a lip formed on a free end of the second panel;

wherein the display member defines a V-shape.

2. A display member according to claim 1 wherein the display panel has a display means for displaying advertisements, information or indicia.

3. A display member according to claim 1 wherein the second panel has a back edge facing said display panel, said locking member being formed on said back edge.

4. A display member according to claim 1 wherein the display panel is integrally formed with the second panel.

5. A display member according to claim 1 wherein the display panel is integrally formed of a resilient plastic material.

6. Use of the display member of claim 1 for displaying indicia pertaining to items on a shelf.

7. A display system for attachment to a shelf, the display system comprising:

a holding means for attachment to the shelf, the holding means having a front panel and an internal panel, the front panel being connected to the internal panel, the holding means defining a retaining member formed between the front panel and the internal panel; and a display means having a display panel and a second panel attached to the display panel, the second panel including a free end having a locking member, the locking member being a lip formed on said free end, the second panel being slidably received between the front panel and the internal panel of the holding means such that the locking member securely engages said retaining member.

8. A display system according to claim 7 wherein the retaining member is a groove.

9. A display system according to claim 7 wherein the free end of the second panel has a back edge facing said display panel, said locking member being formed on said back edge.

10. A display system according to claim 7 wherein the display means removably engages the holding means.

11. A display system according to claim 7 wherein the holding means includes a back panel connected to the internal panel, the front panel and the back panel being connected to the internal panel to define a Z-shape.

12. A display system according to claim 11 wherein the internal panel includes a stopping member connected thereto near a junction between the internal panel and the back panel.

13. Use of the display system of claim 7 for displaying indicia pertaining to items on a shelf.

14. A display member to engage with a holding member having two panels and retaining means located between the two panels, the display member comprising:

a display panel; and a second panel receivable between the two panels of the holding member, the second panel being connected to the display panel, the second panel having a locking member that is capable of securing the display member to the retaining means of the holding member, the second panel having a back edge facing said display panel, said locking member being a lip formed on said back edge;

wherein the display member defines a V-shape.

15. A display system for attachment to a shelf, the display system comprising:

a holding means for attachment to the shelf, the holding means having a front panel and an internal panel, the front panel being connected to the internal panel, the holding means defining a retaining groove formed between the front panel and the internal panel; and a display means having a display panel and a second panel attached to the display panel, the second panel including a free end having a locking member, the free end having a back edge facing said display panel, said locking member being formed on said back edge, the second panel being slidably received between the front panel and the internal panel of the holding means such that the locking member securely engages said retaining groove.

16. A method for displaying indicia pertaining to items on a shelf including the steps of:

providing a holding means having a front panel and an internal panel, the front panel being connected to the internal panel, the holding means defining a retaining groove formed between the front panel and the internal panel;

attaching the holding means to the shelf;

providing a display means having a display panel and a second panel connected to the display panel, the second panel having a free end defining a locking member, the locking member being a lip formed on said free end;

sliding the second panel of the display means between front panel and the internal panel of the holding means; and engaging the locking member into the retaining groove.

* * * * *